US008763866B2

(12) United States Patent
Oberhofer et al.

(10) Patent No.: US 8,763,866 B2
(45) Date of Patent: Jul. 1, 2014

(54) VESSEL HAVING COMPRESSED $CO_2$ GAS SOURCE

(75) Inventors: Kurt Oberhofer, Wilhelmsfeld (DE); Timm Oberhofer, Wilhelmsfeld (DE)

(73) Assignee: Huber Packaging Group GmbH, Oehringen (DE)

( * ) Notice: Subject to any disclaimer, the term of this patent is extended or adjusted under 35 U.S.C. 154(b) by 1465 days.

(21) Appl. No.: 11/921,538

(22) PCT Filed: May 27, 2006

(86) PCT No.: PCT/EP2006/005089

§ 371 (c)(1),
(2), (4) Date: May 27, 2009

(87) PCT Pub. No.: WO2006/128653

PCT Pub. Date: Dec. 7, 2006

(65) Prior Publication Data

US 2009/0302069 A1 Dec. 10, 2009

(30) Foreign Application Priority Data

Jun. 2, 2005 (EP) ..... 05011896

(51) Int. Cl.
*B65D 83/00* (2006.01)

(52) U.S. Cl.
USPC ..... 222/399

(58) Field of Classification Search
USPC ..... 222/399, 400.7, 396, 394, 386.5, 538, 222/537, 539; 169/81, 82; 141/10, 329, 141/330; 137/540
See application file for complete search history.

(56) References Cited

U.S. PATENT DOCUMENTS

| | | | | |
|---|---|---|---|---|
| 3,244,326 | A * | 4/1966 | Bull, Jr. | 222/61 |
| 3,352,456 | A * | 11/1967 | Swineford | 222/5 |
| 3,460,555 | A * | 8/1969 | Puster | 137/12 |
| 5,110,012 | A * | 5/1992 | Scholle et al. | 222/83.5 |
| 5,215,217 | A * | 6/1993 | Leslie | 222/5 |

* cited by examiner

*Primary Examiner* — Len Tran
*Assistant Examiner* — Viet Le
(74) *Attorney, Agent, or Firm* — Galgano & Associates, PLLC; Thomas M. Galgano; Jessica G. Bower

(57) ABSTRACT

The compressed $CO_2$ gas source is an insert that can be fixed in a sealed manner in an opening of the vessel. The insert has a high-pressure $CO_2$ cartridge, a pressure-regulating valve for discharging $CO_2$ therefrom and a rotary knob that is accessible from the outside. The rotary knob cooperates with an axially guided slide, which can be actuated to pierce the high-pressure $CO_2$ cartridge with a piercing needle.

32 Claims, 4 Drawing Sheets

VESSEL HAVING COMPRESSED $CO_2$ GAS SOURCE

The invention relates to a vessel that can be filled with liquid and closed in pressure-tight condition, and from which liquid can be withdrawn. Examples of such vessels are drums, small drums (party kegs) or cans, in which $CO_2$-containing liquids, especially beverages, are filled under pressure. In particular, it relates to party beer kegs.

There exist tap fittings that operate with high-pressure $CO_2$ cartridges and that can be used to tap such vessels in order to withdraw liquid therefrom by means of $CO_2$ pressure. This corresponds to the standard tapping technique in gastronomy, wherein $CO_2$ from high-pressure $CO_2$ bottles is used and very good wholesomeness and shelf life of the beer are achieved.

In some consumer groups, however, tap fittings with $CO_2$ high-pressure cartridges have not become popular. For persons who buy party beer kegs only occasionally, it is not worthwhile to procure an expensive tap fitting. Some people are even uncomfortable handling high-pressure $CO_2$ cartridges. Others worry about the replacement supply of cartridges.

There have therefore been developed party beer kegs equipped with an integrated outlet tap in the bottom region of the keg, whereby the beer can be drawn by the internal pressure and gravity alone. Usually air is admitted to the party keg above the liquid surface therein, in order to permit pressure equalization. This can be achieved by puncturing with a can opener. However, other party beer kegs have an integrated outlet tap and a hand-operated air-admission valve in the top end plate of the keg, forming part of a bunghole closure (see WO 99/23008 A1).

A disadvantage of such party kegs is that the wholesomeness and shelf life of the beer are impaired by the ingress of air into the top space of the keg. When a party keg of this type is tapped, the contents must be consumed quickly, so that the beer does not become flat and stale.

Several suggestions have been made as regards improving the shelf life of beer in a tapped party keg. For example, WO 99/47451 A1 teaches integrating an aerosol can that contains $CO_2$ bound to active carbon under low pressure into the party keg and building up a $CO_2$ pressure in the top space of the keg sufficient to equal or exceed the partial pressure of the $CO_2$ dissolved in the beer. A disadvantage is the large volume of the can.

From DE 19952379 A1 there is known a $CO_2$ dispenser for party kegs in the form of a separate manual device, with which the party keg is pierced above the liquid surface therein in order to pump $CO_2$ into the top space of the keg. The dispenser contains a high-pressure $CO_2$ cartridge and a pressure-regulating valve. It is intended for multiple uses and can be transferred from party keg to party keg. Even if the $CO_2$ consumption may be smaller than in the case of a tap fitting operating with $CO_2$, such a $CO_2$ dispenser ultimately raises similar concerns in consumer groups.

From practice it is also known that there can be introduced into the top space of a party beer keg a pressure bag, which expands when the pressure in the top space drops, thereby on the one hand filling the empty space being formed and on the other hand exerting a contact pressure on the liquid surface in the keg greater than the partial pressure of the $CO_2$ dissolved in the beer. The pressure bag comprises multiple plies of plastic film that is impermeable to oxygen diffusion. It has a plurality of chambers that contain gas-forming chemicals, such as baking powder and citric acid. The chambers are successively activated as the pressure drops in the top space of the party keg and are inflated by the gas evolved during the reaction of the chemicals.

A disadvantage of the known pressure bag is the unsteady application of pressure on the beer. The pressure rises suddenly when the respective next chamber of the pressure bag is activated, and it then drops successively. This results in irregular tap behavior. The tap behavior fluctuates between discharge of the beer in a strong stream and a mere trickle.

The object of the invention is to provide a vessel of the type mentioned hereinabove having an integrated compressed $CO_2$ gas source of small overall volume, from which discharged $CO_2$ exerts a steady pressure on the liquid in the vessel and improves its shelf life and wholesomeness.

This object is achieved by a vessel having an insert that can be fixed in sealed manner in an opening of the vessel and a high-pressure $CO_2$ cartridge, a pressure-regulating valve for discharging $CO_2$ therefrom and a control element that is accessible from the outside and that can be actuated to pierce the high-pressure $CO_2$ cartridge with a piercing needle. The control element is a rotary knob, which cooperates with an axially guided slide for actuating the piercing needle.

By virtue of its small overall volume, the insert is suitable for replacing the bunghole closure with pressure-equalizing valve according to WO 99/23008 A1, without necessitating any substantial modifications to the shape and size of the respective vessel to be equipped therewith, such as a party beer keg. The processes at a filling plant are altered slightly at most. The insert can be made of plastic materials, which for years have proved most suitable for a bunghole closure with pressure-equalizing valve and an outlet tap. The configuration of the control element as a rotary knob corresponds to that of the widely used pressure-equalizing valve according to WO 99/23008 A1. The operation of the compressed $CO_2$ gas source is routinely so simple that a user familiar with actuation of a conventional pressure-equalizing valve hardly notices any difference. The user does not directly handle a high-pressure $CO_2$ cartridge, which would probably make him uncomfortable. The cartridge is designed for one-time use in a single vessel and will be disposed of together therewith. In particular, the shelf life of beer in a tapped party keg will be extended by several days without concern by filling the top space with $CO_2$ instead of air.

Commercial pierceable $CO_2$ cartridges in a size suitable for the inventive compressed $CO_2$ gas source contain approximately 16 g of $CO_2$ at a pressure of approximately 80 bar. The reduction and precise regulation of the pressure of the $CO_2$ discharged into the top space of the vessel imposes considerable requirements on the construction of a compressed $CO_2$ gas source in the form of a compact insert. The pressure is typically between 0.5 and 0.7 bar. It is equal to or slightly higher than the partial pressure of the $CO_2$ dissolved in the liquid.

Especially for beer, the $CO_2$ content is one of the factors that determines the taste. The $CO_2$ content varies from beer variety to beer variety. If the $CO_2$ pressure in the top space of the party keg is too low, $CO_2$ escapes from the beer. If the $CO_2$ pressure in the top space is too high, the beer becomes overcarbonated and its taste and wholesomeness are impaired. The compressed $CO_2$ gas source described in detail hereinafter ensures that neither one nor the other occurs.

In a preferred embodiment, the rotary knob is mounted to rotate in axially fixed manner. The rotary knob and the slide are in contact with inclined surfaces extending in circumferential direction.

In a preferred embodiment, the inclined surfaces rise with the same slope, in proportion to the circumferential angle. The inclined surfaces merge into one another at step-like axial setbacks.

In a preferred embodiment, four inclined surfaces disposed in a square configuration are provided.

In a preferred embodiment, the slide comes into flush contact with the piercing needle during piercing of the high-pressure $CO_2$ cartridge, such that end face is against end face.

In a preferred embodiment, the piercing needle for piercing the high-pressure $CO_2$ cartridge is structurally combined with a valve member of the pressure-regulating valve, which is axially adjustable between a sealing position and a passing position at a valve seat of the pressure-regulating valve.

In a preferred embodiment, the pressure-regulating valve has a lateral outlet opening, in front of which there is disposed an annular elastic sleeve having non-return function. The sleeve ensures that no liquid can enter the insert. An elastic O-ring may also be used for the same purpose.

In a preferred embodiment, the piercing needle occupies a sealing position directly downstream from the valve seat of the pressure-regulating valve just before piercing takes place. Thereby the volume of the valve space to which the maximum pressure of the high-pressure $CO_2$ cartridge is admitted after it has been pierced is very small.

In a preferred embodiment, the vessel has a tightly sealed chamber, in which the head of the high-pressure $CO_2$ cartridge has a snug fit at the opening of the vessel. The tight seal of the chamber is preferred for hygiene reasons.

In a preferred embodiment, the chamber is closed with a bottom cover, which is welded or bolted to the wall of the chamber. The joint is tight. The high-pressure $CO_2$ cartridge does not come into contact with the liquid constituting the contents of the vessel.

In a preferred embodiment, the high-pressure $CO_2$ cartridge is sealed against the wall of the chamber, around the circumference of its small diameter neck. Thereby the axial forces to which the cartridge is subjected during piercing are limited.

In a preferred embodiment, the insert occupies a top opening of the vessel. The $CO_2$ from the high-pressure $CO_2$ cartridge is discharged into a top space of the vessel above the liquid surface therein.

In a preferred embodiment, the opening that receives the insert is a bunghole, through which the vessel is filled with liquid. The insert functions as the bunghole closure.

The $CO_2$ from the high-pressure $CO_2$ cartridge can be discharged into the top space of the vessel above the liquid surface therein. However, it is also possible to connect a pressure bag to the insert. The pressure bag is pulled on by applying vacuum to the housing of the insert and is tightly heat-sealed to the housing. The pressure bag is ultimately disposed in direct contact with the housing of the insert in the interior of the vessel. It is inflated by the discharged $CO_2$. Compared with the prior art pressure bag mentioned hereinabove, the advantage is then achieved that the filling pressure of the pressure bag is constant, or in other words no pressure fluctuations and irregularities in tapping behavior occur. The filling pressure can be set at a somewhat higher value than the partial pressure of the $CO_2$ dissolved in the liquid, which pressure therefore remains completely unaffected and neutral as regards taste.

In the variant with the pressure bag, a compressed gas other than $CO_2$ may also be injected from a high-pressure cartridge.

In a preferred embodiment, the vessel has an outlet tap at the bottom. Withdrawal of the liquid then takes place by internal pressure and the effect of gravity. The $CO_2$ from the high-pressure $CO_2$ cartridge prevents a reduced pressure from developing in the top space of the vessel. This is possible in the variants with and without pressure bag.

In the variant with the pressure bag, the vessel can have, instead of the outlet tap, a top spigot to which there leads a riser line extending to the bottom of the vessel. The liquid is conveyed by the pressure of the $CO_2$ discharged from the high-pressure $CO_2$ cartridge to the spigot. Tapping at the top of the vessel is more convenient than at the bottom.

In a preferred embodiment, an outlet spout together with a hose connection is provided on the outside of the spigot. The outlet spout is added to the vessel as a separate part. It is clipped onto the said vessel after the spigot has been removed.

The invention will be explained in more detail hereinafter on the basis of exemplary embodiments illustrated in the drawing, wherein.

Figure 1:
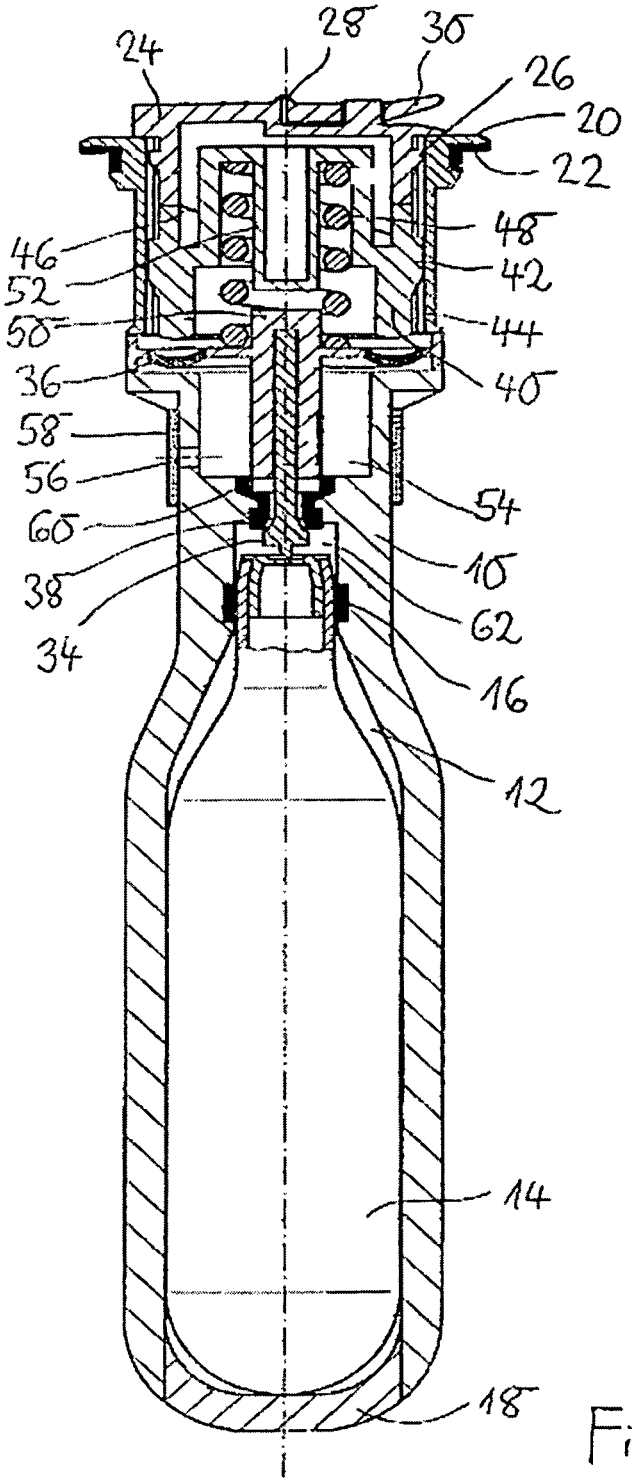
FIG. 1 shows a compressed $CO_2$ gas source in longitudinal section.

The compressed $CO_2$ gas source shown in FIG. 1 is constructed as an insert, which fits in the bunghole of a vessel, extends into the vessel and tightly closes the bunghole. The compressed $CO_2$ gas source can take the place of the bunghole closure with pressure-equalizing valve according to WO 99/23008 A1.

The vessel is filled under pressure with $CO_2$-containing liquid through the bunghole usually disposed at the middle of its top end plate. Thereafter the bunghole is tightly closed with the insert. To withdraw the liquid, there can be used an integrated outlet tap, which is disposed on the side wall of the vessel at the height of the bottom end plate thereof. The liquid flows out under the action of internal pressure and gravity, until a reduced pressure is reached in the top space of the vessel above the liquid surface therein. To adjust this correctly and maintain it in controlled manner, the compressed $CO_2$ gas source is activated. The compressed $CO_2$ gas source injects $CO_2$ into the top space of the vessel under a pressure that corresponds to the partial pressure of the $CO_2$ dissolved in the liquid or that slightly exceeds this partial pressure. Thereby steady emptying of the vessel is ensured. No air is admitted into the top space of the vessel. The $CO_2$ content of the liquid remains constant.

The insert has slender elongated shape, and for the most part is radially symmetric relative to a central axis. It is made largely of plastic. The plastic materials used for its manufacture have proved effective for years for bunghole closures and outlet taps of relevant vessels. The two-component plastic injection-molding technique can be used for manufacture. The hard, inflexible plastic parts are shown as hatched areas in the drawing, and the soft, elastic plastic parts are illustrated as solid black areas.

When the insert is in installed condition, closing the bunghole of the vessel, it projects with a housing 10 into the vessel. At its inside end housing 10 has a chamber 12 for receiving a high-pressure $CO_2$ cartridge 14 in a snug fit. The head of cartridge 14, at the end face of which it can be pierced, is proximal to the bunghole. Cartridge 14 has its smallest diameter at a straight cylindrical neck. Here it is sealed with a circumferential seal 16 against the wall of housing 10.

The inside end of chamber 12 is closed with a cover 18, which is welded or bolted to the wall of housing 10.

Housing 10 is supported externally with a circumferential collar 20 on the beaded rim of the bunghole. On collar 20 there is formed a seal 22, with which the insert seals the bunghole.

A rotary knob 24 countersunk in housing 10 protrudes outwardly beyond collar 20, and can be actuated to pierce the $CO_2$ cartridge. By means of a circumferential shoulder 26 that projects radially outward, rotary knob 24 is mounted in a circumferential groove of housing 10 to rotate in axially fixed manner.

A pull tab 30, which can be bent upward, is linked by a film hinge 28 to the outer end face of rotary knob 24. Pull tab 30 is connected to rotary knob 24 via predetermined break points, which break in clearly visible manner when first bent upward. The predetermined break points constitute a tamper-proof seal.

To pierce $CO_2$ cartridge 14 there is used a piercing needle 34, which is structurally combined with the valve member of a pressure-regulating valve. The valve member is mounted together with an elastic diaphragm 36 at the center of the axis of housing 10. The tip of piercing needle 34 is disposed only a short distance from the end face of $CO_2$ cartridge 14.

During axial positioning movement of piercing needle 34 on $CO_2$ cartridge 14, the valve member lifts from a valve seat 38 of the pressure-regulating valve. Valve seat 38 is made from elastic sealing material and molded onto housing 10.

Piercing needle 34 is urged by a slide 40, which is disposed between rotary knob 24 and piercing needle 34. Slide 40 is guided in longitudinal sliding relationship in housing 10. For this purpose there are used cams 42, which extend radially outward from the surface of slide 40 and engage in axial grooves 44 of housing 10.

Rotary knob 24 and slide 40 are in contact with inclined surfaces 46 extending in circumferential direction. Four inclined surfaces 46 disposed in a square configuration are provided, rising with the same slope in proportion to the circumferential angle and merging into one another at step-like axial setbacks. Slide 40 is displaced axially by turning rotary knob 24.

A helical compression spring 48 is clamped between slide 40 and piercing needle 34. The helical compression spring is disposed around a central, plug-like extension 50 on the outside of piercing needle 34 distal from diaphragm 36 and around a central, axial tappet 52 on the inside of slide 40. Extension 50 and tappet 52 have plane end faces, which are disposed opposite one another with a short distance between. Before piercing takes place, therefore, slide 40 is kept apart from piercing needle 34 by means of helical compression spring 48.

Diaphragm 36 bounds a working space 54 downstream from valve seat 38 of the pressure-regulating valve. Working space 54 has a lateral outlet opening 56, in front of which there is disposed an annular elastic sleeve 58. Sleeve 58 has the function of a non-return valve. It prevents liquid from entering the insert.

To pierce $CO_2$ cartridge 14, pull tab 30 is bent upward and rotary knob 24 is turned by approximately 90°. Slide 40 is moved axially inward against the force of helical compression spring 48. Its tappet 52 comes into flush contact with extension 50 of piercing needle 34, such that one end face is against the other end face. Piercing needle 34 is moved axially inward under elastic deformation of diaphragm 36. Just before it achieves piercing, it occupies a sealing position on a seal 60 directly downstream from valve seat 38 of the pressure-regulating valve. The valve member lifts from valve seat 38. After piercing, a very small valve space 62 upstream from the head of $CO_2$ cartridge 14 fills with $CO_2$ under high pressure.

After rotary knob 24 has turned a complete 90° or more, slide 40 springs axially back outward under the force of helical compression spring 48. Piercing needle 34 is also retracted axially by the elastic return deformation of diaphragm 36, the pressure-regulating valve is closed and a small amount of $CO_2$ under high pressure is admitted into working space 54. Further opening and closing of the pressure-regulating valve is determined by an equilibrium of forces across diaphragm 36, established by the elastic properties of diaphragm 36, the spring constant of helical compression spring 48 and the $CO_2$ pressure in working space 54. The determining factor for the pressure of the discharged $CO_2$ is the spring constant of helical compression spring 48.

Usually the user will activate the compressed $CO_2$ gas source when the internal pressure in the vessel has dropped so much that the stream of liquid emerging through the outlet tap is too weak. However, the compressed $CO_2$ gas source can already be activated beforehand without difficulty even if the internal pressure in the vessel is still high. Introduction of $CO_2$ into the top space of the vessel does not take place as long as the high internal pressure is acting on sleeve 58 in front of outlet opening 56.

Figure 2:
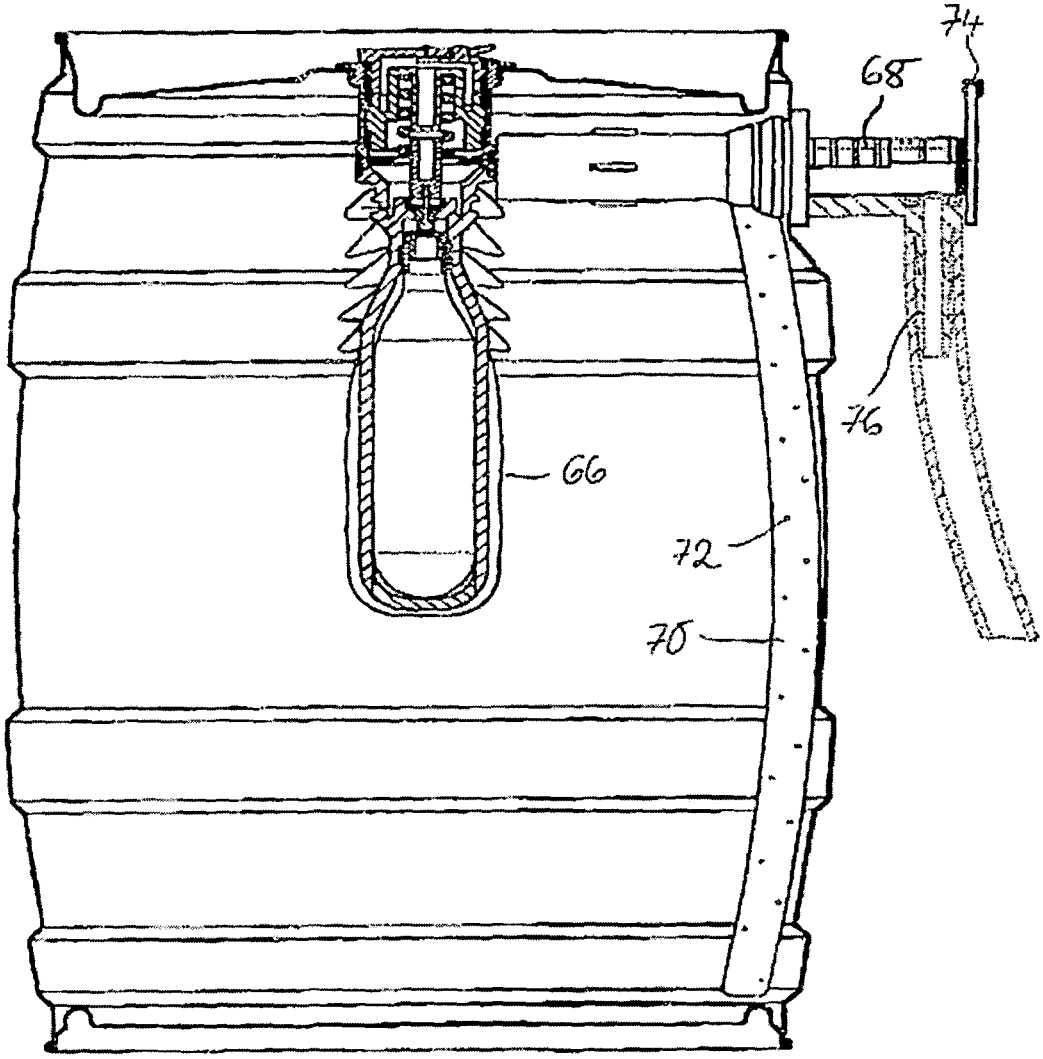
FIG. 2 shows the side view of a cut-away vessel containing the compressed $CO_2$ gas source, to which a pressure bag is connected, as a bunghole closure.
Figure 3:
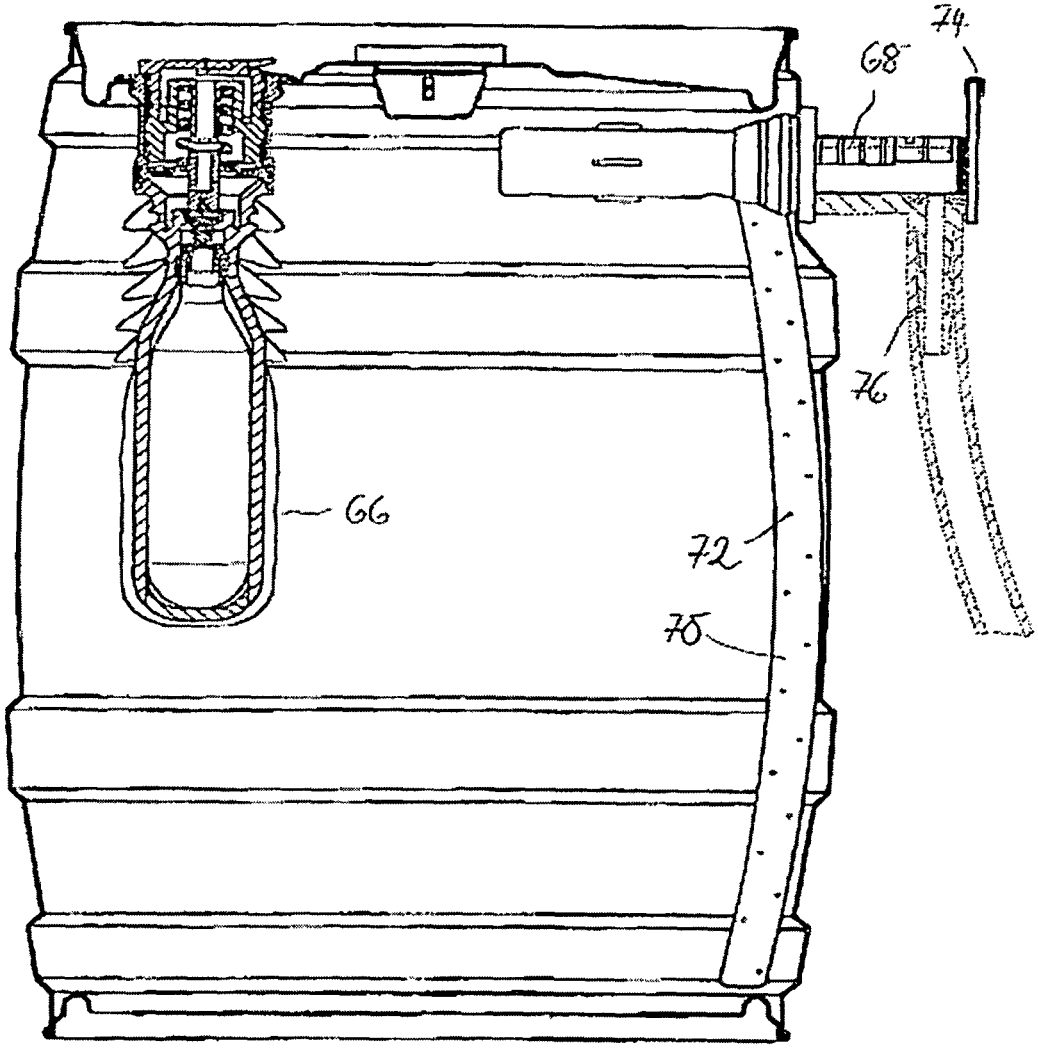
FIG. 3 shows the corresponding view of a vessel containing the compressed $CO_2$ gas source in a separate opening of the top end plate of the vessel.
Figure 4:
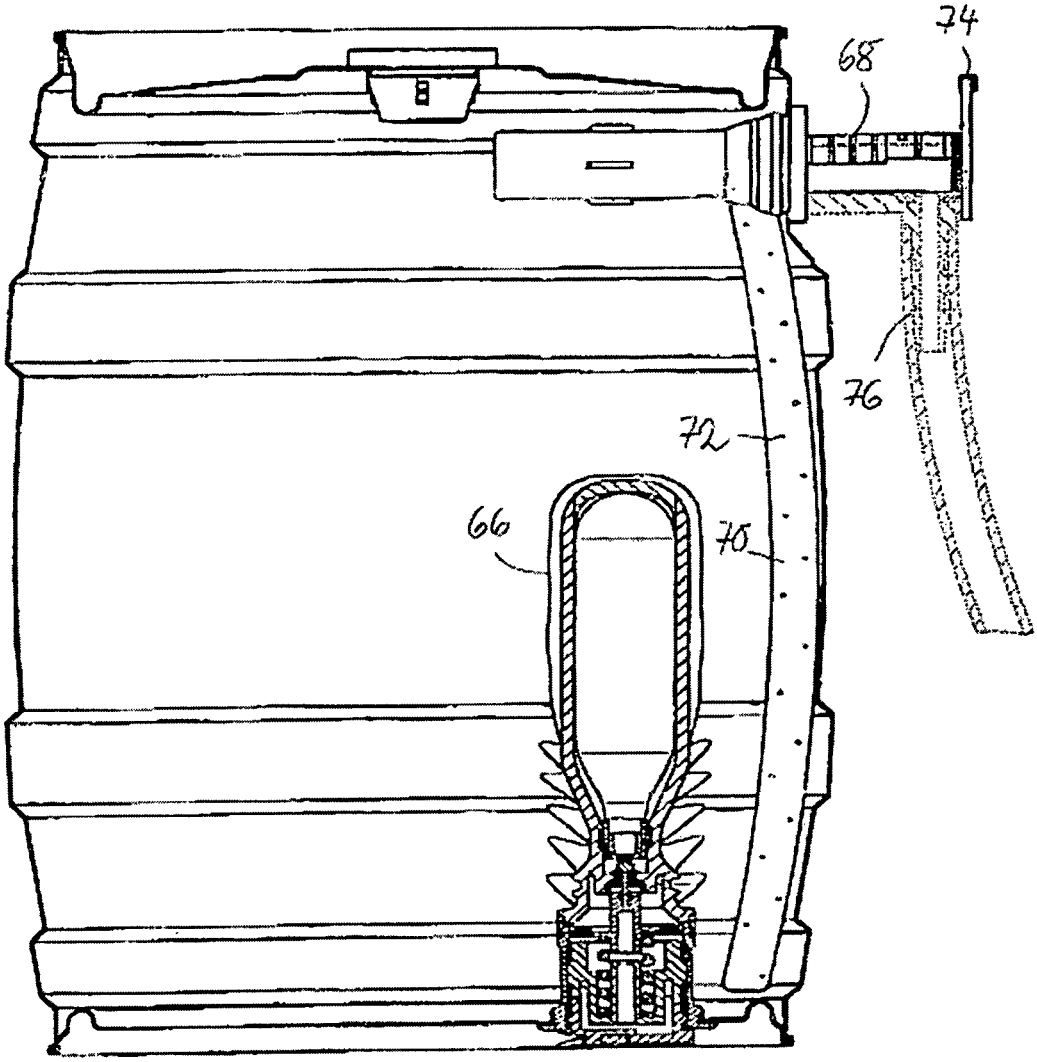
FIG. 4 shows the corresponding view of a vessel containing the compressed $CO_2$ gas source in an opening of the bottom end plate of the vessel.

According to FIG. 2 to FIG. 4, sleeve 58 is omitted. Instead, the compressed $CO_2$ gas source is connected to a pressure bag 66, which surrounds housing 10 and can be inflated by the discharged $CO_2$.

Instead of an outlet tap, the vessel has an integrated spigot 68, which is disposed on the side wall of the vessel at the height of its top end plate. A riser line 70 that extends to the bottom end plate of the vessel leads to spigot 68. Riser line 70 has surface holes 72 in the manner of a drainage line. An actuating part 74 and an outlet spout 76 together with a hose connection are provided externally on spigot 68.

In FIG. 2, the compressed $CO_2$ gas source functions as a bunghole closure of a bunghole, which is disposed at the center of the top end plate of the vessel and is used for filling the vessel. In FIG. 3, the compressed $CO_2$ gas source is seated in a separate lateral opening of the top end plate of the vessel, and in FIG. 4 it is seated in an opening of the bottom end plate of the vessel.

List of reference numerals

| | |
|---|---|
| 10 | Housing |
| 12 | Chamber |
| 14 | High-pressure $CO_2$ cartridge |
| 16 | Seal on cartridge |
| 18 | Cover |
| 20 | Collar |
| 22 | Seal on collar |
| 24 | Rotary knob |
| 26 | Shoulder |
| 28 | Film hinge |
| 30 | Pull tab |
| 34 | Piercing needle |
| 36 | Diaphragm |
| 38 | Valve seat |
| 40 | Slide |
| 42 | Cam |
| 44 | Axial groove |
| 46 | Inclined surface |
| 48 | Helical compression spring |
| 50 | Extension |
| 52 | Tappet |
| 54 | Working space |
| 56 | Outlet opening |
| 58 | Sleeve |

-continued

| List of reference numerals |
|---|
| 60 Seal for needle |
| 62 Valve space |
| 66 Pressure bag |
| 68 Spigot |
| 70 Riser line |
| 72 Surface hole |
| 74 Actuating part |
| 76 Outlet spout |

The invention claimed is:

1. A vessel that can be filled with liquid and closed in a pressure-tight condition, and from which liquid can be withdrawn, comprising:

an insert that can be fixed in a sealed manner in an opening of the vessel comprising:

a housing having a longitudinally extending central axis;

a high-pressure $CO_2$ cartridge disposed within said housing;

a pressure-regulating valve for regulating the discharge of $CO_2$ from said cartridge;

a piercing needle for piercing said high-pressure $CO_2$ cartridge; and a rotary knob, engageable with said piercing needle, to actuate piercing of said high-pressure $CO_2$ cartridge, said rotary knob being rotatably mounted in said housing to permit rotation of said rotary knob about said central axis and in a longitudinally fixed manner to prevent movement of said rotary knob longitudinally within said housing, and said rotary knob being accessible from outside of the vessel;

a longitudinally guided slide received within said housing, which engages with said rotary knob and said piercing needle to actuate said piercing needle; and inclined surfaces extending in circumferential direction on said rotary knob, which are in contact with said slide, for moving said slide and said piercing needle longitudinally towards said high-pressure $CO_2$ cartridge for piercing said high-pressure $CO_2$ cartridge upon rotation of said rotary knob.

2. A vessel according to claim 1, wherein said slide comes into flush contact with said piercing needle during piercing of the high-pressure $CO_2$ cartridge, such that end face is against end face.

3. A vessel according to claim 1, wherein said piercing needle is structurally combined with a valve member of the pressure-regulating valve, wherein said valve member is axially adjustable between a sealing position and a passing position at a valve seat of the pressure-regulating valve.

4. A vessel according to claim 1, wherein said pressure-regulating valve has a lateral outlet opening, in front of which there is disposed an annular elastic sleeve.

5. A vessel according to claim 1, wherein said piercing needle occupies a sealing position directly downstream from a valve seat of the pressure-regulating valve just before piercing takes place.

6. A vessel according to claim 1, wherein said vessel has a tightly sealed chamber, wherein the head of the high-pressure $CO_2$ cartridge has a snug fit at the opening.

7. A vessel according to claim 6, wherein said chamber is closed with a bottom cover, wherein said bottom cover is welded or bolted to the wall of the chamber.

8. A vessel according to claim 6, wherein said high-pressure $CO_2$ cartridge is sealed against the wall of the chamber, around the circumference of its small diameter neck.

9. A vessel according to claim 1, wherein said insert occupies a top opening of the vessel, and wherein $CO_2$ from the high-pressure $CO_2$ cartridge can be discharged into a top space of the vessel above the liquid surface therein.

10. A vessel according to claim 1, wherein said opening is a bunghole, through which the vessel can be filled with liquid, and in that the insert functions as the bunghole closure.

11. A vessel according to claim 1, wherein a pressure bag, which can be inflated by the discharged $CO_2$, is connected to the insert.

12. A vessel according to claim 1, wherein said vessel has an outlet tap at the bottom.

13. A vessel according to claim 1, wherein said vessel has a spigot located at the top, to which there leads a riser line extending to the bottom of the vessel.

14. A vessel according to claim 13, wherein an outlet spout together with a hose connection is provided on the outside of said spigot.

15. A vessel according to claim 1, wherein said pressure-regulating valve has a lateral outlet opening, in front of which there is disposed an O-ring having non-return function.

16. The vessel according to claim 1, wherein:

said rotary knob has a shoulder which extends radially outwardly therefrom along its circumference and said housing has a circumferential groove formed therein which is configured and dimensioned for receipt of said shoulder therein to permit rotation of said rotary knob about said central axis in said longitudinally fixed manner.

17. A vessel that can be filled with liquid and closed in a pressure-tight condition, and from which liquid can be withdrawn, comprising:

an insert that can be fixed in a sealed manner in an opening of the vessel comprising:

a housing having a longitudinally extending central axis;

a high-pressure $CO_2$ cartridge disposed within said housing;

a pressure-regulating valve for regulating the discharge of $CO_2$ from said cartridge;

a piercing needle for piercing said high-pressure $CO_2$ cartridge, said piercing needle having a central extension on the outside thereof;

a rotary knob, engageable with said piercing needle, to actuate piercing of said high-pressure $CO_2$ cartridge, said rotary knob being rotatably mounted in said housing to permit rotation of said rotary knob about said central axis and in a longitudinally fixed manner to prevent movement of said rotary knob longitudinally within said housing, and said rotary knob being accessible from outside of the vessel;

a longitudinally guided slide received within said housing, which engages with said rotary knob and said central extension on said piercing needle to actuate said piercing needle; and inclined surfaces extending in circumferential direction on said rotary knob, which are in contact with said slide, for moving said slide and said piercing needle longitudinally towards said high-pressure $CO_2$ cartridge for piercing said high-pressure $CO_2$ cartridge upon rotation of said rotary knob;

wherein upon rotation of said rotary knob, said inclined surfaces of said rotary knob cause said slide to move longitudinally towards said central extension on said piercing needle to cause said piercing needle to move longitudinally towards said high-pressure $CO_2$ cartridge, such that said piercing needle pierces said high-pressure $CO_2$ cartridge.

18. A vessel according to claim 17, wherein said slide comes into flush contact with said piercing needle during piercing of the high-pressure $CO_2$ cartridge, such that end face is against end face.

19. A vessel according to claim 17, wherein said piercing needle is structurally combined with a valve member of the pressure-regulating valve, wherein said valve member is axially adjustable between a sealing position and a passing position at a valve seat of the pressure-regulating valve.

20. A vessel according to claim 17, wherein said pressure-regulating valve has a lateral outlet opening, in front of which there is disposed an annular elastic sleeve.

21. A vessel according to claim 17, wherein said piercing needle occupies a sealing position directly downstream from a valve seat of the pressure-regulating valve just before piercing takes place.

22. A vessel according to claim 17, wherein said vessel has a tightly sealed chamber, wherein the head of the high-pressure $CO_2$ cartridge has a snug fit at the opening.

23. A vessel according to claim 22, wherein said chamber is closed with a bottom cover, wherein said bottom cover is welded or bolted to the wall of the chamber.

24. A vessel according to claim 22, wherein said high-pressure $CO_2$ cartridge is sealed against the wall of the chamber, around the circumference of its small diameter neck.

25. A vessel according to claim 17, wherein said insert occupies a top opening of the vessel, and wherein $CO_2$ from the high-pressure $CO_2$ cartridge can be discharged into a top space of the vessel above the liquid surface therein.

26. A vessel according to claim 17, wherein said opening is a bunghole, through which the vessel can be filled with liquid, and in that the insert functions as the bunghole closure.

27. A vessel according to claim 17, wherein a pressure bag, which can be inflated by the discharged $CO_2$, is connected to the insert.

28. A vessel according to claim 17, wherein said vessel has an outlet tap at the bottom.

29. A vessel according to claim 17, wherein said vessel has a spigot located at the top, to which there leads a riser line extending to the bottom of the vessel.

30. A vessel according to claim 29, wherein an outlet spout together with a hose connection is provided on the outside of said spigot.

31. A vessel according to claim 17, wherein said pressure-regulating valve has a lateral outlet opening, in front of which there is disposed an O-ring having non-return function.

32. The vessel according to claim 17, wherein:

said rotary knob has a shoulder which extends radially outwardly therefrom along its circumference and said housing has a circumferential groove formed therein which is configured and dimensioned for receipt of said shoulder therein to permit rotation of said rotary knob about said central axis in said longitudinally fixed manner.

* * * * *